United States Patent [19]

Ohta et al.

[11] 4,118,654

[45] Oct. 3, 1978

[54] AUTOMATIC LIGHT INTENSITY CONTROL FOR X-RAY FILM VIEWER

[75] Inventors: Takahiro Ohta; Akira Muramatsu, both of Asaka, Japan

[73] Assignee: Fuji Photo Film Co., Ltd., Minami-ashigara, Japan

[21] Appl. No.: 745,754

[22] Filed: Nov. 29, 1976

[30] Foreign Application Priority Data

Dec. 4, 1975 [JP] Japan ..... 50-144831

[51] Int. Cl.[2] ..... H05B 37/02

[52] U.S. Cl. ..... 40/361; 250/205; 315/158; 315/194; 315/151

[58] Field of Search ..... 315/151, 158, 159, 194, 315/DIG. 4; 250/205; 355/35, 37, 88, 113; 40/106.1

[56] References Cited

U.S. PATENT DOCUMENTS

| | | | |
|---|---|---|---|
| 3,473,084 | 10/1969 | Dodge | 315/151 |
| 3,796,916 | 3/1974 | DeBelder | 315/151 |
| 3,952,242 | 4/1976 | Ukai | 315/158 X |

*Primary Examiner*—Eugene R. LaRoche
*Attorney, Agent, or Firm*—Sughrue, Rothwell, Mion, Zinn and Macpeak

[57] ABSTRACT

The intensity of light penetrating an X-ray film being viewed is automatically maintained at a preset, adjustable, eye comfort level. A photosensor detects the average light level on the observer side, and its output controls the charging time of a capacitor coupled to the emitter of a unijunction transistor. When the capacitor reaches a predetermined voltage it fires the transistor and dumps its charge through a pulse generator which in turn triggers a gated semiconductor connected in series with the viewer light source. The period between successive firing cycles is proportional to the penetrating light level. Thus, if the light level increases, as when a relatively transparent film negative is inserted in the viewer or when a negative is removed, the capacitor charging time increases, the firing period increases, and the light source intensity therefore decreases to restore the preset level of light penetration.

7 Claims, 4 Drawing Figures

AUTOMATIC LIGHT INTENSITY CONTROL FOR X-RAY FILM VIEWER

BACKGROUND OF THE INVENTION

This invention relates to an automatic light intensity control system for a high-density X-ray film viewer.

Industrial X-ray pictures are employed for inspecting the interior of a metallic member or casting, or a weld of such a casting, and, in general, such pictures have a very wide density range. Accordingly, in order to enable the detection of defects from a high-density film, a viewer capable of providing a high degree of illumination must be used. With such a viewer, however, an observer's eyes are quickly dazzled when directly exposed to the bare viewer screen, and he therefore becomes easily fatigued. Even when a film is placed in the viewer, depending upon the configuration and the density of the photographed object, detailed observation is difficult and tedious because the brightness is excessive or the contrast is too low. To overcome this difficulty, a viewing device with a manual light intensity control has been proposed. However, such a device still suffers from a variety of disadvantages, as described below. Whenever a film is placed in the viewer, the intensity of the light must be manually adjusted, and it is therefore difficult to maintain constant illumination conditions at all times. Further, when the film is removed the observer's eyes are exposed to intense light and are therefore dazzled or temporarily blinded. To avoid this the light control must be manually adjusted whenever a film is inserted in or removed from the viewer.

SUMMARY OF THE INVENTION

According to this invention, no matter what the density of a film is the observer can always view it as an image having a constant brightness. Furthermore, when no film is inserted in the viewer the brightness of the illumination surface is automatically reduced, and accordingly the observer's eyes will never be dazzled.

The viewer according to this invention is an automatic light intensity control type of photographic image viewer having a light source and a light diffusion illumination surface, a photo-detector spaced from the illumination surface to sense the light penetrating through the surface, and means for controlling the brightness of the light source in response to the signal produced by the photo-detector.

The photo-detector is disposed on the observer side of the device to detect the level of light passing through the film placed adjacent to the illumination surface. The photo-detector may be mounted at various positions, as determined by, inter alia, the range of penetration density of a given X-ray film. That is, in some instances the average density over the entire X-ray film must be detected, and in other situations the density of just a particular portion or area of the film must be detected. Depending upon these circumstances, the directional orientation and the mounting position of the photo-detector may be suitably determined.

Both ordinary and industrial X-ray pictures usually having the image of an object at their central portion, and accordingly the peripheral or outside part of the picture is directly irradiated with X-rays. Such peripheral part of the picture has high density, and accordingly, the photo-detection of the central portion of the film is most suitable in such instances. If a small size film is being viewed, then the illumination should be shielded from the other parts of the screen with a suitable mask.

A second point which should be taken into consideration is to minimize the effect of ambient light at the place where the observation is carried out. For this purpose, it is desirable to shield the ambient light with a hood, for example, and to properly set the mounting angle of the photo-detector with respect to the plane of the film.

A third point is the arrangement of the photo-detector so that it does not obstruct the placing of the film on the viewer or its removal, and does not interfere with the observation of the film.

It is desirable that the spectral sensitivity characteristic of the photo-detector lies in the visible light region only. Otherwise, the ultraviolet or infrared light components are detected whereby the intensity of the light source is erroneously controlled. A filter may be employed for this purpose in front of a silicon photo-transistor, or a semiconductor detector in which such a filter is built-in may be used. Alternately, a cadmium sulphide photo-detector may be employed because it is primarily sensitive to light in the visible region.

It is preferable to employ a thyristor circuit as a means for controlling the brightness of the light source. When the density of the film is high the light input to the photo-detector is small, and therefore the brightness of the light source is increased so that the light input to the photo-detector is increased. Conversely, if the film density is low, the brightness of the light source is decreased.

The combination of an adjustable automatic light intensity control and a manual light intensity control is convenient in practical use. The adjustment of the automatic control is necessary for varying the light level depending on the ambient brightness and the observer's wish. The manual light control is necessary because there are some X-ray film objects which are not suitable for automatic light control. That is, manual light control must be used, for instance, where a part of the object corresponding to the measuring range of the photo-detector is hollow or high in density, and it is desired to view other parts of the film.

Briefly, and according to this invention, the intensity of light penetrating an X-ray film being viewed is automatically maintained at a preset, adjustable, eye comfort level. A photo-sensor detects the average light level on the observer side, and its output controls the charging time of a capacitor coupled to the emitter of a unijunction transistor. When the capacitor reaches a pedetermined voltage it fires the transistor and dumps its charge through a pulse generator which in turn triggers a gated semiconductor connected in series with the viewer light source. The period between successive firing cycles is proportional to the penetrating light level. Thus, if the light level increases, as when a relatively transparent film negative is inserted in the viewer or when a negative is removed, the capacitor charging time increases, the firing period increases, and the light source intensity therefore decreases to restore the preset level of light penetration.

DETAILED DESCRIPTION OF THE PREFERRED EMBODIMENTS

Figure 1:
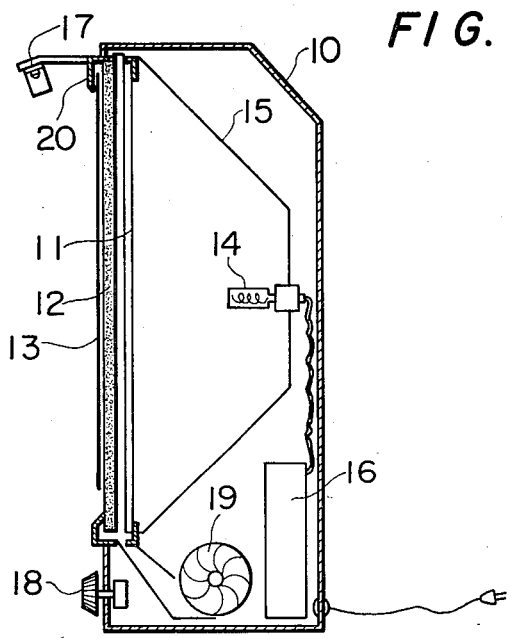
FIG. 1 shows a schematic sectional view of a first embodiment of an X-ray viewer according to this invention, employing a halogen lamp light source.

Referring to the accompanying drawings, FIG. 1 shows a schematic sectional view of a first embodiment of an X-ray film viewer according to the invention comprising a casing or chamber 10, a light source or lamp 14, a reflecting plate 15, a heat absorbing glass plate 11, a light diffusion plate 12, clips 20 for holding an X-ray film 13, a photo-detector 17 for detecting the intensity of the light penetrating through the film, a light control circuit 16 disposed at the lower part of the housing, a manual control knob 18 for setting the intensity level of the light, and a blower 19 for cooling the diffusion plate 12. The lamp 14, photo-detector 17, and control knob 18 are electrically connected to the light control circuit 16.

Figure 2:
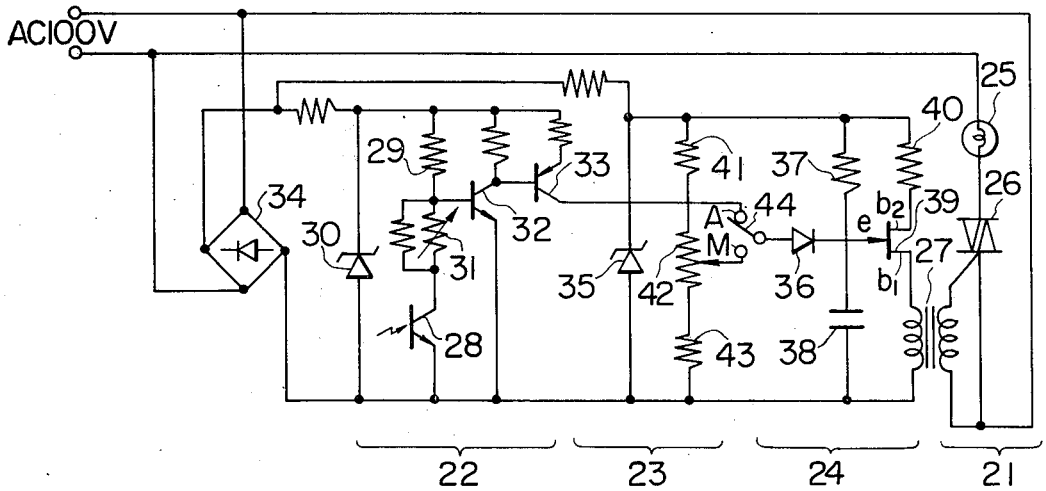
FIG. 2 shows a schematic circuit diagram for controlling the embodiment of FIG. 1.

The FIG. 2 shows a schematic circuit diagram of one embodiment of a light control circuit 16 for the viewer of FIG. 1 which employs a halogen lamp as the light source 14. This circuit can be divided into four sections: a lamp circuit 21, a light receiving circuit 22, a manual light controlling circuit 23, and a pulse generating circuit 24. The lamp circuit 21 is fundamentally made up of a light source or lamp 25 and a bi-directional thyristor (TRIAC)26 connected in series across the a.c. power source. The lamp circuit further comprises a thermally operative fuse or temperature fuse, not shown. To control the brightness of the lamp 25, a pulse generated by the circuit 24 is applied to the gate of the TRIAC 26 through a pulse transformer 27, in such a manner as to phase-control the a.c. power source.

In the light receiving circuit 22, a photo-transistor 28, which detects the intensity of the light passing through the X-ray film, is connected through a fixed resistor 29 and a variable resistor 31 across a constant voltage regulated power supply made up of a Zener diode 30 and a diode rectifier bridge 34.

When the photo-transistor 28 receives no light it is non-conductive and a constant voltage is thus amplified by transistors 32 and 33 and applied, as a lamp brightness control voltage, to the pulse generating circuit 24. On the other hand, when the photo-transistor 28 receives light it is rendered conductive and the voltage applied to the base of transistor 32 is reduced. The conduction of photo-transistor 28 is proportional to the intensity of the light incident thereon, and thus as the intensity of the light increases the brightness control signal decreases.

In the pulse generating circuit, a full-wave rectification voltage is applied through a resistor to a Zener diode 35 to obtain a constant voltage, which serves to charge a capacitor 38 through a resistor 37. In addition, the above-described lamp brightness control voltage is also applied to the capacitor 38 through a change-over switch 44 and a diode 36. Accordingly, the charging time of the capacitor 38 is a function of the sum of the lamp brightness control voltage and the charging voltage. The capacitor voltage is applied to the emitter of a unijunction transistor 39, one base $b_2$ of which is connected through a resistor 40 to the power supply, while the other base $b_1$ is grounded through the pulse transformer 27. When the emitter voltage, or the voltage across the capacitor 38, exceeds a predetermined value, the unijunction transistor 39 is rendered conductive and the capacitor 38 is discharged through the pulse transformer 27. After discharge of the capacitor 38 the transistor 39 is rendered non-conductive, and the capacitor 38 begins to charge again. At the time of discharge a pulse is generated in the secondary winding of the pulse transformer 27 to trigger the TRIAC 26. The period or frequency of recurrence of this triggering pulse is determined by the magnitudes of the superimposed brightness and control voltages. As the intensity of the light applied to the photo-transistor 28 is increased, the brightness control voltage is decreased and the period of time between successive triggering pulses is increased, as a result of which the brightness of the lamp 25 is decreased. In addition, since the brightness control voltage may be changed by varying the resistance of the variable resistor 31 in the light receiving circuit 22, the brightness level of the lamp may be adjusted by appropriately setting the resistor 31 through a further control knob, not shown.

For manual control, the superimposed brightness voltage is derived from a voltage dividing circuit consisting of resistors 41, 42, and 43 by tripping the armature of a change-over switch 44 in the manual light controlling circuit 24. The resistor 42 is variable, and light control can thus be achieved by manually changing its resistance via the control knob 18 in FIG. 1.

Thus, and as described above, the light passing through the X-ray film is detected, and the light source is automatically controlled in response thereto so that the penetrating light is maintained at a constant level of intensity. Accordingly, the observer views the film at a substantially constant intensity level, which may be suitably adjusted or set according to each individuals eye comfort. When the film is removed from the device the intensity of the lamp is automatically reduced, and the eyes of the observer are thus not dazzled or blinded by a bright illumination surface.

Figure 3:
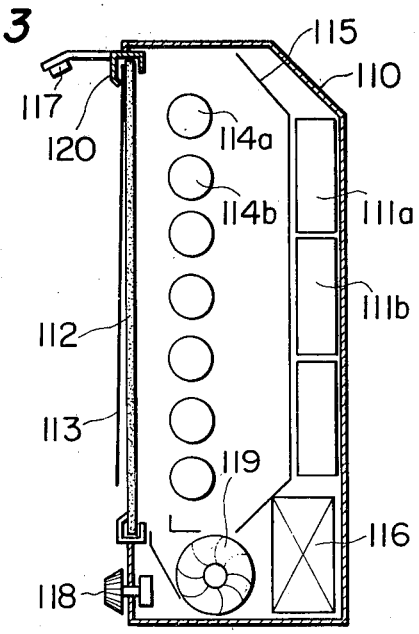
FIG. 3 shows a schematic sectional view of a second embodiment of the invention, employing fluorescent lamps as the light source.
Figure 4:
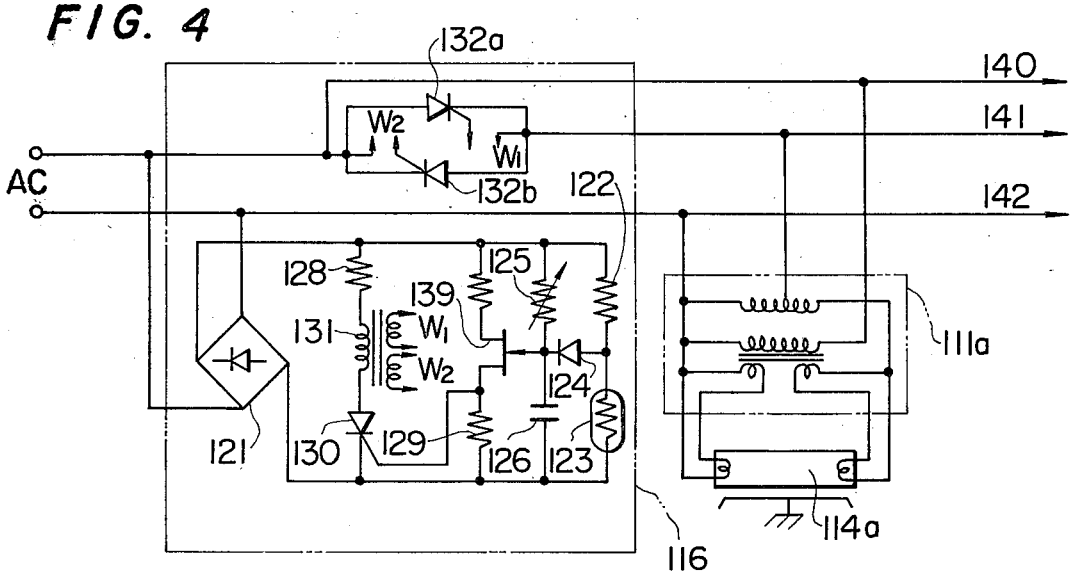
FIG. 4 shows a schematic circuit diagram for controlling the second embodiment.

FIGS. 3 and 4 show a schematic sectional view and a light control circuit, respectively, illustrating another embodiment of the invention, wherein the X-ray film viewer employs fluorescent lamps. The device, as shown in FIG. 3, comprises a housing or chamber 110, a plurality of fluorescent lamps 114*a*, 114*b*, . . . , a diffusion plate 112, clips 120 for holding an X-ray film 113, a photo-detector 117 for detecting the penetrating light, a control circuit 116 placed at the lower portion of the chamber, a knob 118 for manually setting the intensity level of the light, and a cooling blower 119. The electrical wiring is not shown in FIG. 3, but it will be described with reference to FIG. 4.

The circuit of FIG. 4 is similar to the halogen lamp light control circuit shown in FIG. 2, and employs a cadmimum sulphide photo conductive cell (CdS cell). The essential elements of the circuit shown in FIG. 4 are the light control circuit 116, the fluorescent lamp 114*a* (the other fluorescent lamps being omitted for simplification), and a stabilizer or ballast 111*a* for the fluorescent lamp. In the control circuit 116 a full wave rectification voltage obtained through a diode bridge 121 is divided by a resistor 122 and a CdS cell 123, and is applied, as a pedestal voltage, to a capacitor 126 through a diode 124. The capacitor 126 is charged through a variable resistor 125. The voltage across the capacitor is applied to the emitter of a unijunction transistor 139. When the voltage across the capacitor reaches a predetermined value the transistor 139 is rendered conductive, whereupon the capacitor is quickly discharged while the emitter voltage is lowered. As a result, the transistor becomes non-conductive again. When the transistor 139 fires, a pulse is produced which triggers an SCR 130. Since the SCR is connected in series across the full-wave rectified voltage through a resistor 128 and a pulse transformer 131, pulses are produced in the secondary windings W1 and W2 of the pulse transformer. These pulses serve as trigger pulses for SCR's 132*a* and 132*b* connected in series in the light control line.

When the light penetrating the X-ray film is low in intensity the resistance of the CdS cell 123 increases and the pedestal voltage becomes high. The emitter voltage of the unijunction transistor 139 is the sum of this pedestal voltage and the charging voltage according to a time constant defined by the values of the variable resistor 125 and the capacitor 126. Accordingly, when the pedestal voltage is increased, the period of time required for charging the cpacitor to its firing level is shortened, and the time period between successive transistor firings is shortened. Therefore, with the aid of the SCR light control circuit, the period of time during which the fluorescent lamp is energized is increased, and the light intensity is increased. In contrast, when the intensity of the penetrating light is high, the intensity of the fluorescent lamp is decreased. Thus, the quantity of the penetrating light is maintained at a substantially constant level.

A heater line 140, a light control line 141, and a common line 142 are connected to the fluorescent lamps 114*a*, 114*b*, . . . respectively through light control stabilizers 111*a*, 111*b*, . . . In order to smoothly control the intensity of light, rapid start fluorescent lamps are employed. As is apparent from the above description, even if the device employs fluorescent lamps as the light source, the objects of the invention can be easily achieved using the embodiment shown in FIGS. 3 and 4.

Fluorescent lamps are advantageous in that they exhibit high color temperatures, provide uniform illumination, and consume less power. However, fluorescent lamps are disadvantageous for viewing industrial X-ray films in that their itensity level is low and therefore a number of fluorescent lamps must be employed. In addition, fluorescent lamps must be provided with ballast or stabilizer coils, which increases their weight. Finally, the light control circuit per se is more intricate and costly than that for an incandescent lamp.

Where a halogen lamp is employed as the light source, the light control circuit is simpler and the weight is less. However, a halogen lamp is disadvantageous in that a relatively large quantity of heat is generated, the color temperature is low, and the color temperature varies with the degree of light control. Accordingly, the particular light source should be selected depending upon the types of film to be viewed by the device.

The fact that the illumination intensity is automatically reduced when a film is removed has the added merits of reducing power consumption and heat generation, which also prolongs the service life of the lamps.

The present invention has been described only with reference to X-ray film viewing. However, it goes without saying that the concept of the invention can be widely applied, for example to devices for observing light transmissive films such as color photography films.

What is claimed is:

1. In a photographic film viewer including a light diffuser screen, means for positioning a film adjacent one side of the screen, a housing surrounding the other side of the screen, and a light source disposed within the housing for projecting light through the screen and film, automatic light intensity control means comprising:

a. photo-detector means spaced from the screen on said one side thereof opposite the housing and oriented with respect to the plane of the film to detect only the intensity of light penetrating through the vicinity of the center portion of the screen and film and to shield ambient light therefrom, and b. electrical circuit means for automatically controlling the brightness of the light source in response to an output signal from the photo-detector means, whereby the brightness of the light source is increased when the light penetrating through the screen and film decreases, and vice versa.

2. A photographic film viewer as defined in claim 1 wherein the electrical circuit means comprises:

a. a light receiving circuit responsive to the photo-detector means output for producing an output voltage inversely proportional to the detected level of light penetrating through the screen and film, b. a capacitor coupled to said output voltage and charged thereby, c. means including a unijunction transistor and a pulse transformer for generating a current pulse when the capacitor charge reaches a predetermined level, and d. a gate controlled semiconductor switch connected in series with the light source across a power source and conductively responsive to said current pulse.

3. A photographic film viewer as defined in claim 2 further comprising manual control means for adjusting the charging voltage applied to the capacitor.

4. A photographic film viewer as defined in claim 3 wherein the manual control means is operable in conjunction with the photo-detector means.

5. A photographic film viewer as defined in claim 3 wherein the manual control means is operable independently of the photo-detector means.

6. A photographic film viewer as defined in claim 2 wherein the light source is a halogen lamp and the photo-detector means is a photo-transistor.

7. A photographic film viewer as defined in claim 2 wherein the light source is a fluorescent lamp and the photo-detector means is a cadmium sulphide cell.

* * * * *